US005234564A

United States Patent [19]

Smith

[11] Patent Number: 5,234,564

[45] Date of Patent: Aug. 10, 1993

[54] MOBILE SCREEN ASSEMBLY FOR RUBBLE AND DEBRIS

[76] Inventor: Roger G. Smith, 17693 S.W. Blue Heron Rd., Lake Oswego, Oreg. 97034

[21] Appl. No.: 918,841

[22] Filed: Jul. 24, 1992

[51] Int. Cl.[5] ..... B07B 1/00; B07B 1/28; B07B 1/49

[52] U.S. Cl. ..... 209/241; 209/257; 209/317; 209/421

[58] Field of Search ..... 209/240, 241, 247, 257, 209/314, 315, 317, 420, 421, 935

[56] References Cited

U.S. PATENT DOCUMENTS

| | | | |
|---|---|---|---|
| 517,724 | 4/1894 | Beers | 209/421 |
| 2,115,110 | 4/1938 | Keil | 209/314 |
| 2,366,222 | 1/1945 | Tocci-Guilbert | 209/421 |
| 2,703,649 | 3/1955 | Cheyette | 209/314 |
| 2,864,561 | 12/1958 | Mork | 209/420 |
| 3,322,354 | 5/1967 | Ostermann et al. | 209/315 |
| 4,256,572 | 3/1981 | Read | 209/420 |
| 4,363,725 | 12/1982 | Morita et al. | 209/257 |
| 4,861,461 | 8/1989 | Utterback | 209/241 |
| 4,956,078 | 9/1990 | Magerowski et al. | 209/315 |
| 4,983,280 | 1/1991 | Eriksson | 209/241 |
| 5,097,610 | 3/1992 | Bishop | 209/420 |
| 5,100,537 | 3/1992 | Krause | 209/935 |
| 5,106,490 | 4/1992 | McDonald | 209/420 |
| 5,120,433 | 6/1992 | Osadchuk | 209/241 |

FOREIGN PATENT DOCUMENTS

| | | | |
|---|---|---|---|
| 212642 | 9/1956 | Australia | 209/421 |
| 285882 | 1/1991 | Fed. Rep. of Germany | 209/935 |
| 1488026 | 6/1989 | U.S.S.R. | 209/314 |
| 1553667 | 10/1979 | United Kingdom | 209/421 |

OTHER PUBLICATIONS

Product Brochure: Universal Potable Apron Feeder (no date available).

Product Brochure: Universal Feeder System (no date available).

*Primary Examiner*—Robert P. Olszewski

*Assistant Examiner*—Steven M. Reiss

*Attorney, Agent, or Firm*—Kolisch Hartwell Dickinson McCormack & Heuser

[57] ABSTRACT

A vehicle for feeding and screening material including a wheel-supported vehicle frame and a material-transport conveyor extending from one end of the vehicle frame to a raised end located between the ends of the vehicle frame. A multiple deck screen assembly forms an extension of the material-transport conveyor, and inclines downwardly toward a discharge end located at the opposite end of the vehicle frame. Off-bearing conveyors are adjustable to transport screened material laterally of the vehicle frame.

8 Claims, 3 Drawing Sheets

MOBILE SCREEN ASSEMBLY FOR RUBBLE AND DEBRIS

BACKGROUND AND SUMMARY OF THE INVENTION

This invention relates to a vehicle for feeding and screening material. The vehicle includes a feeder system for feeding material, a screen assembly for screening material fed thereto by the feeder system, and conveyor or transporting structure for conveying material processed by the screen assembly. A vehicle of this description has utility in processing soil or dirt where the soil has mixed with it rocks, concrete pieces, stumps, stones, discarded hardware, and other debris. After processing, a dirt and debris mixture as above described may be separated into multiple piles, with one containing essentially soil, and other piles of differently sized material having commercial use as a recycled product. The feeding and screening of material is an increasingly important aspect of cleaning up our environment.

Generally, an object of the invention is to provide a novel vehicle for the handling of material of different screen sizes, adapted to have such material deposited thereinto, and then to feed and to screen the material, with material subsequently discharged to different pile locations.

Another object is to provide such a vehicle capable of efficiently handling a mixture of dirt and debris, or refuse, where the debris may include objects of substantial size, as well a multiple gradations of smaller size.

A further object is to provide a vehicle which includes a screen assembly and means for feeding material to the screen assembly, as well as conveyors for conveying different classifications of material away from the vehicle, with all such structure combined on a vehicle which is conveniently moved over the road.

Yet another object is to provide a vehicle which includes a feeding means and a screen assembly for screening product fed, as well as conveyors for conveying product to different locations, and which further includes a novel system for blocking the frame of the vehicle with the vehicle at an operating site, whereby the vehicle frame and all the components mentioned are supported in a stable manner on ridged leg structure, and not through the suspension system and wheels of the vehicle.

The vehicle contemplated when set up at an operating site provides a completely self-contained plant for handling material and screening material. Operating components are of a rugged construction, and may have a size sufficient to impart to the vehicle a capability of handling substantial tonnages of material per hour of operation. The vehicle when ready for road transport is sufficiently compact to enable it to comply with the usual state regulations governing road transport. The vehicle, nevertheless, is easily set up at an operating site in an operating state, without the need of extensive auxiliary equipment to preform the set-up operation.

BRIEF DESCRIPTION OF THE DRAWINGS

These and other objects and advantages are attained by the invention, which is described hereinbelow in conjunction with the accompanying drawings, wherein.

DETAILED DESCRIPTION OF A PREFERRED EMBODIMENT

Figure 1:
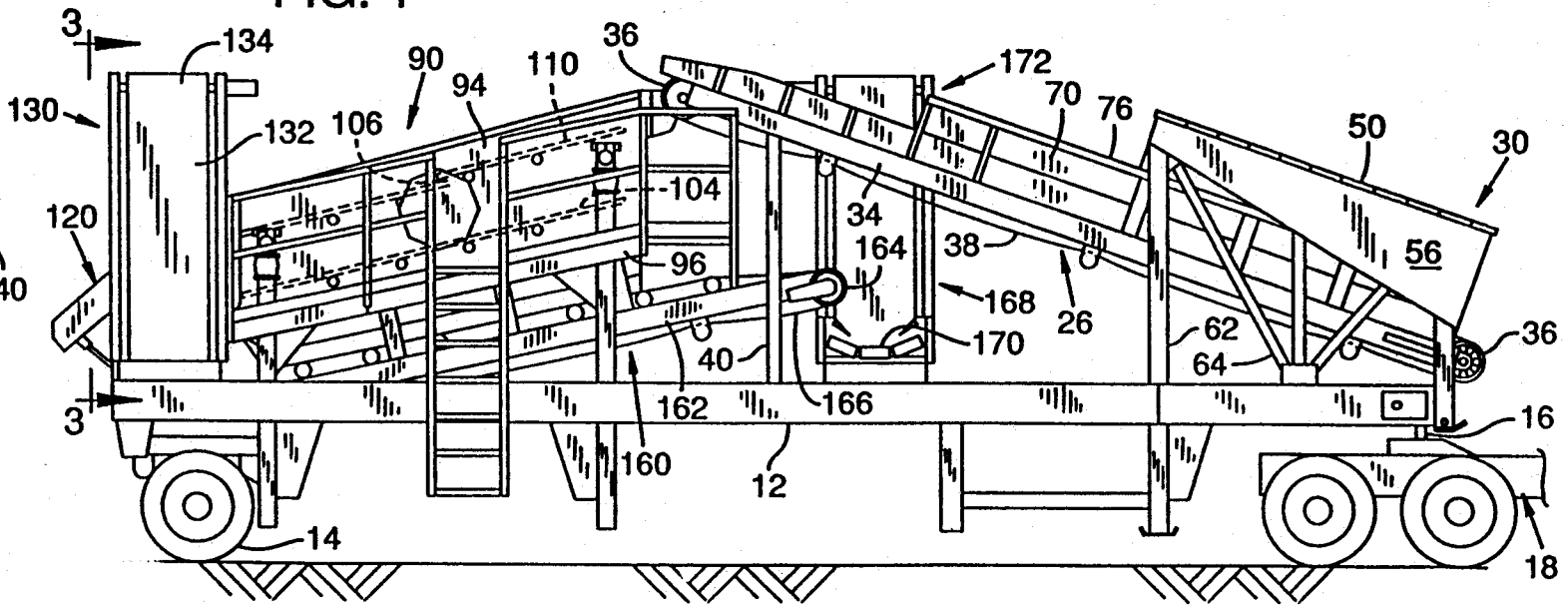
FIG. 1 is a side elevation illustrating a vehicle constructed according to an embodiment of the invention.
Figure 2:
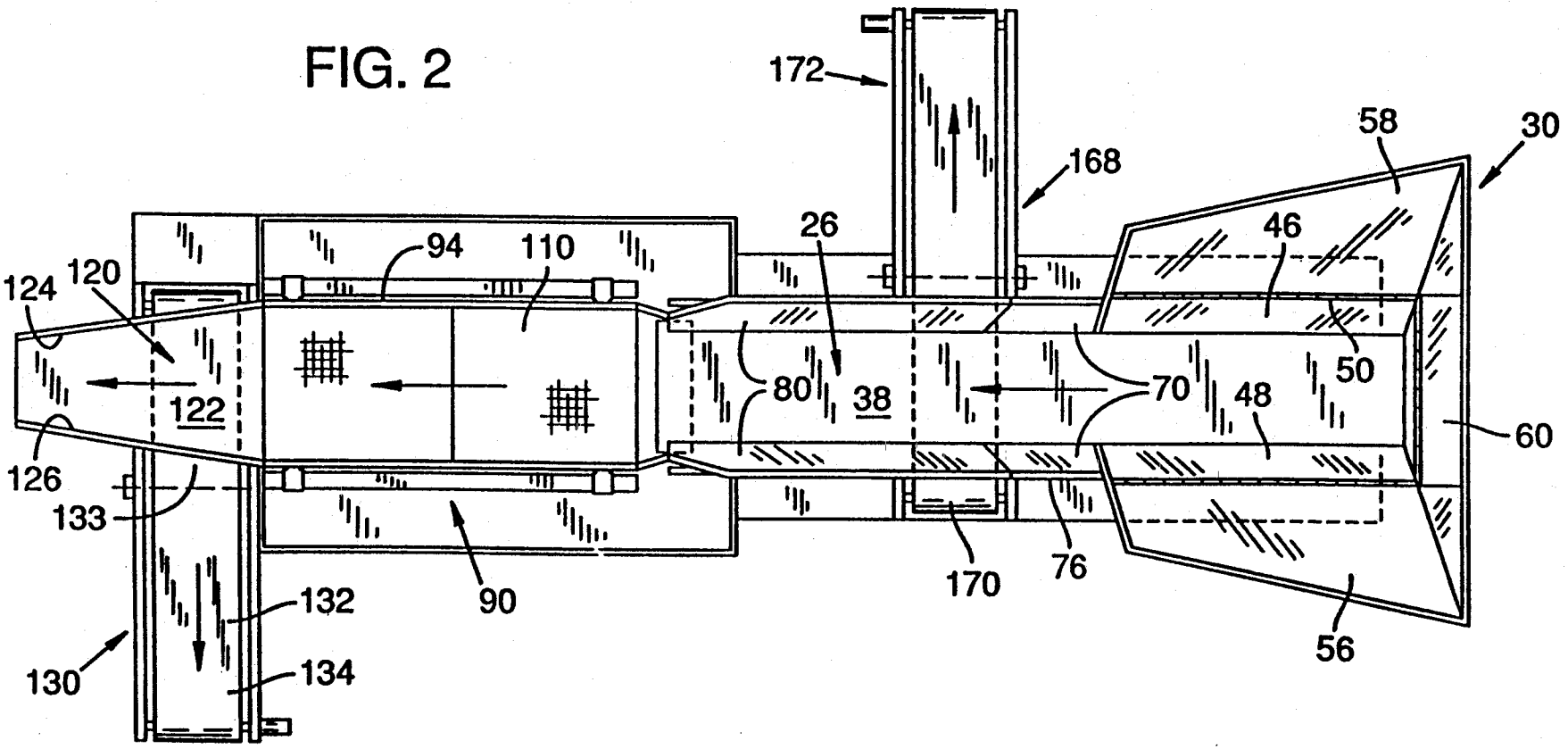
FIG. 2 is a simplified view looking down at the top of the vehicle in FIG. 1.
Figure 7:
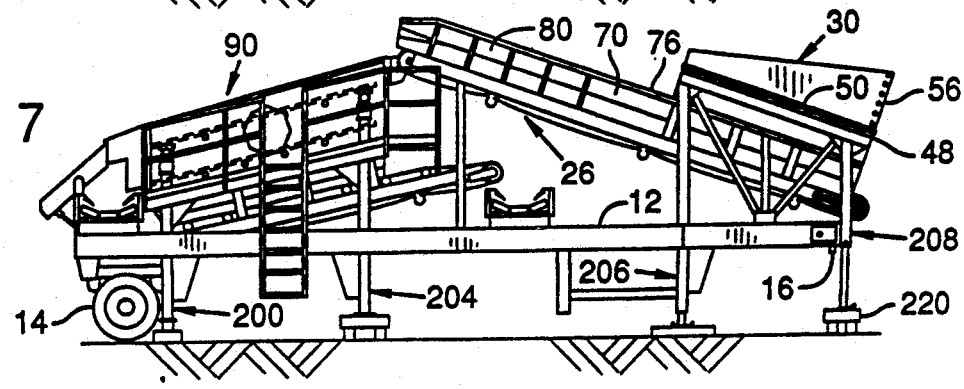

A feeding a screening vehicle constructed pursuant to the invention is indicated generally at 10. In FIG. 1, and FIGS. 4, 5 and 6, the vehicle is shown in its travel condition, which adapts the vehicle for movement over the road with the vehicle conforming to state and federal regulations governing height, width, and length. In FIG. 7, the vehicle is shown in its operating condition or the condition, that it has with the vehicle set up at an operating site ready to function as a plant for the feeding and screening material. In FIG. 2, the vehicle is also shown in its operating state or condition.

The vehicle includes an elongate vehicle frame given the reference number 12. Supporting one end of the frame for movement over the ground, which is the rear end of the frame in the particular embodiment illustrated, are the usual transport wheels 14. The opposite end of the vehicle frame, which is the frame's forward end, mounts a hitch component 16 which is connectable with suitable hitch structure at the rear of a drawing vehicle or tractor to ready the vehicle for movement as a trailer over the road or highway. In FIG. 1, the rear portions of such a drawing vehicle or tractor are shown at 18.

The forward portion of the vehicle includes a hopper and an inclined, material-transport conveyor which carries material fed from the hopper rearwardly to an elevated position on the vehicle. The material-transport conveyor is shown at 26, and the hopper at 30.

The transport conveyor in the usual instance may extend a substantial portion of the length of the vehicle frame, and in the particular form of the invention illustrated, extends from adjacent the forward end of the vehicle frame to slightly beyond its midpoint progressing from the forward to the rear end of the frame. With a conveyor of this length, it is possible to produce substantial elevation of the material handled by the conveyor without the necessity of an excessive incline or slope in the conveyor, which would introduce problems of material tending to free slide rearwardly without being carried forwardly with conveyor movement.

The transport conveyor includes rollers, including end rolls 36, journaled on an elongate conveyor frame 34 training an elongate imperforate elastomer conveyor belt 38. The conveyor frame is rigidly supported on vehicle frame 12 by suitable structure including struts 40. The belt is moved under power by a suitable motor, with the upper run of the belt moving from right to left in FIG. 1.

Hopper 30 is disposed over a lower inclined portion of the inclined transport conveyor. The hopper includes opposite, lower side sections 46, 48 (see FIG. 2), with bottom edges extending alongside and adjacent opposite margins of belt 38. Hinged, as at 50, to these lower side sections are hopper wing walls 56, 58. With the vehicle in traveling condition, the wing walls are swung downwardly to the position shown in FIG. 1, which serves to lower the overall height at the forward part of the vehicle, and contributes to stability. In an operating position, the wing walls are swung upwardly to the position shown in FIGS. 2 and 7, to become upward extensions to the lower side sections. With the wing walls raised, adjustable end section 60 is swung into place, to complete an outwardly flaring top portion of the hopper.

The hopper is suitably supported on the vehicle frame through uprights 62 and braces 64.

It should be noted, and referring to FIG. 2, that the hopper is completely open at the forward end of the hopper. This is referred to herein as a completely open forward throat for the hopper, which is advantageous, as it means that randomly encountered large objects such as stumps, used plumbing hardware, rocks, etc., are free to move forwardly and upwardly with the conveyor belt without meeting an over hanging obstruction which would impede such motion. Also contributing to the ability of the apparatus to handle odd-sized large pieces is the incline of the conveyor throughout that extent of the conveyor which forms the bottom of the hopper. Any material which drops into the hopper and which finds its way to the base of the hopper will tend to be pulled forwardly and upwardly from the hopper with the conveyor, and without any restriction to forward movement at the forward end of the hopper.

Appropriately mounted on frame 34 of the conveyor, immediately in advance of the hopper, are a pair of opposed, fixed, elongate skirt boards 70. These skirt boards have lower edges adjacent the upper belt run of conveyor belt 38, and from these lower edges extend upwardly and then incline outwardly to terminate in upper edges such as the edge shown in 76. These skirt boards help to maintain material suitable located over the conveyor belt as the material is carried forwardly and upwardly by the belt.

Removable skirt boards 80, 82 (see FIGS. 2 and 7) are mounted on the frame of the conveyor and located on either side of the conveyor belt immediately in front of skirt board 70. With the vehicle in its travel condition, these skirt boards are removed, as illustrated by the vehicle shown in FIG. 1. With the vehicle in its operating condition, and functioning as a plant for the screening of material at a given site, the skirt boards are mounted in place as shown in FIG. 2 and FIGS. 4–6. The skirt boards are removed from their position on either side of the belt with the vehicle in its travel condition to lower the overall height of the equipment.

Mounted as a continuation of the material-transport conveyor, in a position extending from approximately the midpoint of the vehicle to the rear end of the vehicle, is a multiple deck screen assembly, given the reference numeral 90.

The screen assembly includes a suitable supporting framework, including frame members 94 and side panels 96, which support the screen assembly on the vehicle frame 12. The assembly illustrated has two decks, namely upper deck 100 and lower deck 104.

Each deck includes a heavy-duty screening extending along the length of the deck. The screening on the top deck has a courser mesh than the screening on the deck below it. The screening in both decks slopes or inclines downwardly progressing from the feed end of the screen assembly, which is directly adjacent the outfeed end of the material-transport conveyor, to the discharge end of the assembly, which is located at the rear of the vehicle approximately over wheels 14.

As is conventional, both decks, and the screening in the deck, are vibrated or oscillated back-and-forth by suitable means which promotes movement of loose material down the incline of a given deck as separation occurs, with smaller sized material dropping through the screen to the region below it.

The screening in the top deck is at two different levels, so that a step, indicated at 106 in FIG. 1, is provided in the deck approximately midway between its ends. The step provides a significant drop for material as such travels down the top deck progressing from the feed to the discharge end of the deck. This drop creates a rolling action for material as such moves over the step and drops to the lower level of the deck. This rolling action introduces a cleaning action, with dirt and small material tending to be shaken loose of the larger product such as stumps, etc.

Material on traveling through the screen assembly is separated into three different fractions. The largest fraction, comprising stumps, large rocks, etc., travels down the upper deck without passing through the screen of the deck and thence onto a material-channelling or -conveying structure 120. Specifically, such structure in the form of the invention illustrated comprises a chute having an inclined floor 122 and bounded by side walls 124, 126. The largest material leaving the upper deck of the screen assembly travels onto this chute thence to be deflected into a region located rearwardly of the rear end of the vehicle.

Figure 3:
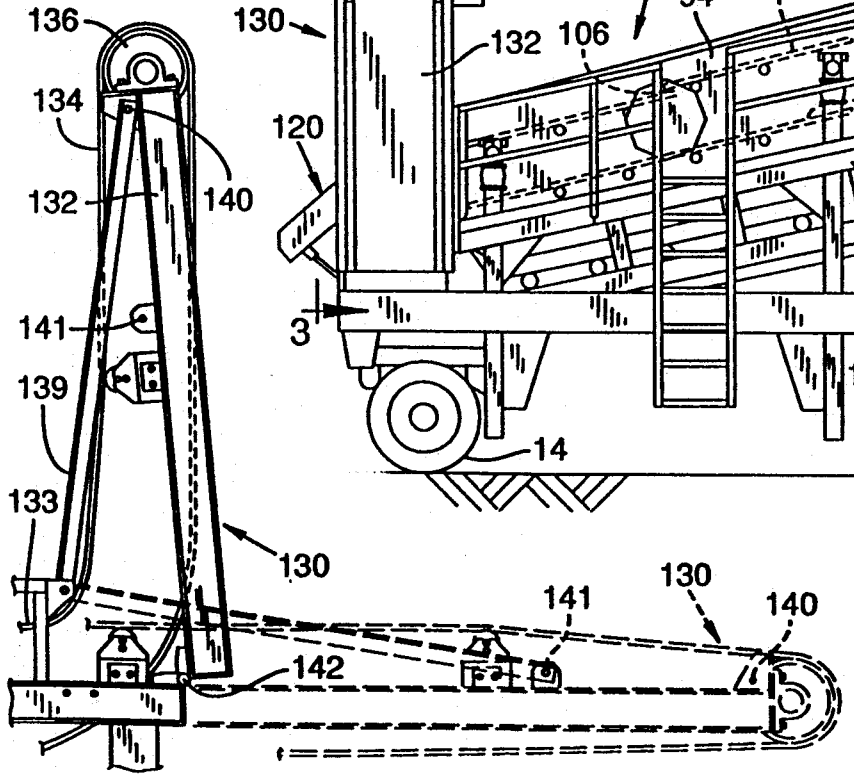
FIG. 3 is a cross-sectional views, taken generally along the lines 3—3 in FIG. 1, showing further details of a conveyor in the vehicle.

Adjacent the rear end of the vehicle, and referring to FIGS. 1, 2 and 3, and shown at 130, is an adjustable conveyor. The conveyor includes a swinging conveyor section 132 occupying an upright position on one side of and adjacent the vehicle with the vehicle in its travel condition and a conveyor in its inoperative position. The conveyor further includes a lower section 133 extending across the vehicle. The conveyor has an elongate imperforate elastomer belt, such as the one shown at 134 trained over suitable rollers, as exemplified as those shown at 136. Section 133 of the conveyor is slightly below the outfeed end of lower deck 104 in the screen assembly. This adjusts conveyor 130 from its inoperative position to an operative or extended position.

Swinging conveyor section 132, with removal of fastener 140 to release strut 139 (see FIG. 3), is pivotable about pivot 142 to assume a horizontal position extending laterally to one side of the rear end of the vehicle frame, as shown in solid outline in FIG. 2 and in dashed outline in FIG. 3. Swinging section 132 is secured in a horizontal position by securing strut 139 to bar 141 (see FIG. 3).

Belt 134 is power-driven to produce movement of the upper run of the belt as shown by the arrow in FIG. 2, which is in a direction extending outwardly from the vehicle frame. Material which passes through the upper deck screen and is retained on the lower deck, on cascading down the incline of the lower deck, is deposited on conveyor 130 to collect as a pile at the off-bearing end of section 132 with the section in its horizontal position.

As shown in FIG. 1, extending under the lower deck of the screen assembly, and in an inclined position, is what is referred to as an under-screen conveyor 160. This includes a conveyor frame 162 mounting suitable rollers 164, these rollers training an elongate imperforate elastomer belt 166. This conveyor extending throughout a portion of its length completely under the lower deck of the screen assembly, and functions to collect material which passes through this lower deck and to convey this material upwardly and toward the front of the vehicle frame.

Directly adjacent and below the outfeed end of this under-screen conveyor is the base or feed portion 170 of another adjustable conveyor 168. This conveyor, like conveyor 130, includes a swinging or pivoted section 172 which, with the vehicle in its travel condition and the conveyor in an inoperative position, is upright, as shown in FIG. 1.

The conveyor like conveyor 130 includes a suitable belt trained on rollers. With the vehicle set into in its operating condition, pivoted section 172 is swung about its pivot mounting to extend in a horizontal position laterally to the opposite side of the vehicle from conveyor 130.

Under-screen conveyor 160 and together with off-bearing conveyor 168 are utilized to reuse the material which passes through both screens of the conveyor assembly and to convey such forwardly and laterally outwardly to another pile remotely located from the other two piles produced by the vehicle during the screening operation.

Referring to FIGS. 4 through 7, the vehicle is provided with four sets of support leg structures, shown at 200, 204, 206, and 208. These are used in blocking the vehicle frame in a stable supported position, and with the weight of the vehicle and its components removed from transport wheels 14.

Figure 4:
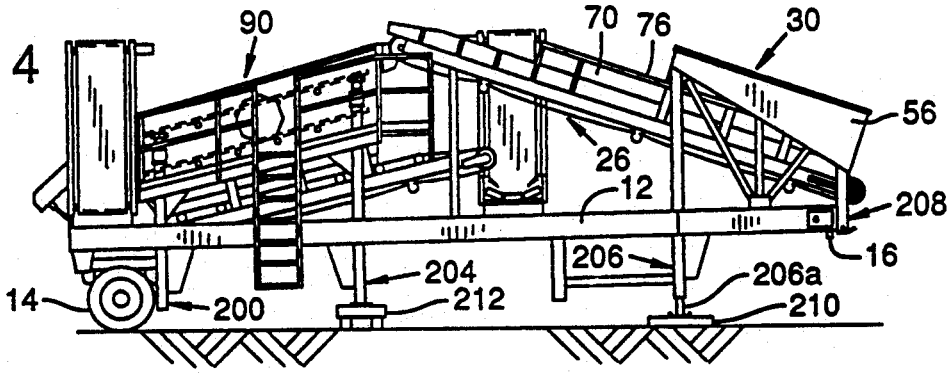
FIGS. 4, 5, 6, and 7 are side elevations of the vehicle illustrating support legs that are provided, and how such may be utilized in the blocking of the vehicle frame to stabilize it with the vehicle set up at an operating site for operation as a feeding and screening plant.

In setting up the vehicle after having arrived at the site where the vehicle is to be blocked in position as an operating plant, the hydraulic legs of leg structure 206, such as leg **206*a* shown in FIG. 4, are extended against a block 210, and the vehicle uncoupled from the drawing vehicle or tractor 18. The hydraulic legs of structure 206 are further extend, and when fully extended, blocks, such as block 212, are placed under the middle blocking point which is provided by support leg structure 204. This is the condition of the parts shown in FIG. 4**.

Figure 5:
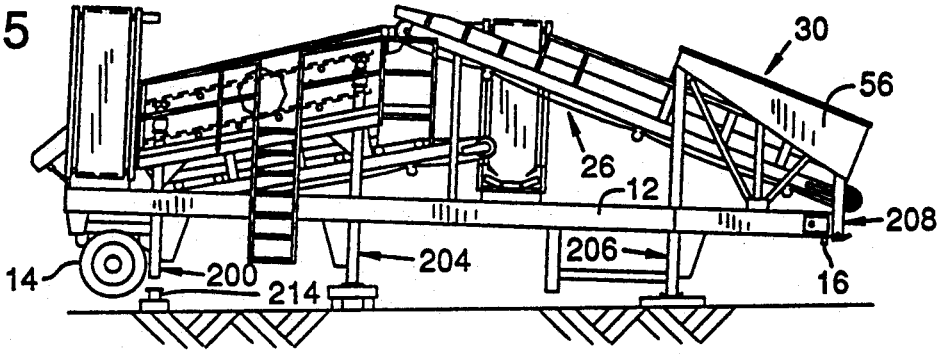
Figure 6:
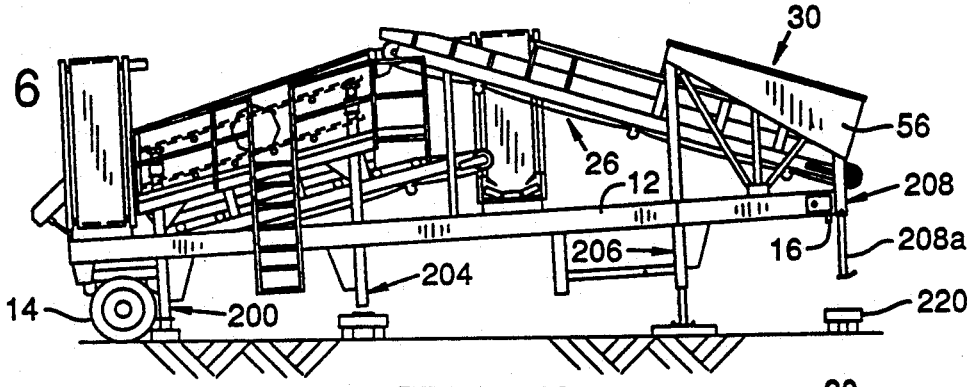

The vehicle is then "kneeled" to the lowest point for the forward end of the vehicle, by contracting hydraulic legs **206*a*. This raises the rear end of the vehicle. Blocks, such as block 214, are then placed over the rear leg support structure 200, as shown in FIG. 5**.

The forward end of the vehicle is then raised by extending hydraulic legs **206*a*. This pivots the vehicle about leg structure 200. The extendable legs of leg structure 208 are then released by unpinning them, and these extendable legs such as the ones shown at 208*a*, are then pinned in an appropriate extended position. Suitable blocking is placed under these extendable legs, shown at 220. This is the condition of the parts shown in FIG. 6**.

The vehicle frame may then be placed in the horizontal position by releasing hydraulic legs **206*a* of leg structure 206. This causes the forward end of the vehicle to drop with legs 208*a* coming against blocks 220 and support legs 204 coming against blocks 212. The vehicle is now fully blocked, and ready for operation. This is the condition of the parts illustrated in FIG. 7**.

With the vehicle set up at an operating location, the hopper wing walls may be raised and secured in place. Removable skirt boards 80, may be mounted in proper position as extensions of skirt boards 70. The swing sections of off-bearing conveyors 130, 168 may be swung down to their horizontal position. This places the vehicle in its operating condition, which is shown in FIGS. 1 and 7.

The vehicle which has been described when set up in its operating condition, is a heavy-duty screening plant, designed for heavy-duty screening of materials which are the basis of today's recycle industries. For instance, the plant when set up may recover top soil, and separate from the soil the crushable materials and oversized product which may be reprocessed.

Material moving down the sloped screen decks of the screen assembly is efficiently cleaned and separated. Very large material, such as stumps, large rocks, etc., while moving down the step portion of the top deck, tends to be rolled over with additional cleaning action imparted thereto.

The product that is processed is separated into multiple stock piles, located at distinctly different regions around the vehicle frame. Course material travels down the top deck of the vibrated screen assembly onto material channelling structure 120, thence to collect as a pile at the rear of the vehicle. Material passing through the top deck and collected on the lower deck is conveyed laterally outwardly by rear conveyor 130, to a pile located on one side of the vehicle. Material passing through both decks is deposited on the under-screen conveyor 160 to be moved upwardly and to the forward portion of the vehicle, whence the material drops onto conveyor 168 to be conveyed to a pile disposed laterally outwardly on the opposite side of the vehicle from the pile produced from the material moved by conveyor 130.

While providing an efficiently operating screening plant when set up and an operating site, the apparatus, nevertheless, is readily moved over the road when the need arises. To ready the vehicle for road movement, all that is required is to remove and store skirt boards 80, and detach and swing to their lowered positions the upper sections of the hopper, as exemplified by wing walls 56, 58 and end wall 60. Swinging of the swing sections 132, 172 of the conveyors 130, 168 to their upright positions reduces the side-to-side dimensions of the vehicle.

While a particular embodiment of the invention has been described, obviously changes and variations are possible without departing from the invention. Included within the invention are such modifications and variations that come within the scope of the appended claims.

It is claimed and desired to secure by Letters Patent:

1. A vehicle for screening material comprising:

an elongate wheel-supported vehicle frame, an elongate power-driven material transport conveyor extending lengthwise along the vehicle frame and having a feed end adjacent one end of the vehicle frame and inclining upwardly to a discharge end located toward the vehicle's opposite end, a hopper adapted for the feeding thereinto of material mounted on the vehicle frame above the feed end of the material-transport conveyor, a screen assembly having a feed end adjacent and in receiving relation to the discharge end of the material-transport conveyor and inclining downwardly toward a discharge end located adjacent the vehicle's opposite end, and a power-driven under-screen conveyor supported on the vehicle frame with a feed end adjacent the discharge end of the screen assembly and extending from its feed end to a discharge end located toward the vehicle's said one end;

said under-screen conveyor inclining upwardly extending from its feed to its discharge end, and the vehicle further including an adjustable conveyor adjustable from an inoperative position to an extended position extending laterally of the vehicle frame and having a feed end positioned to receive material falling from the discharge end of the under-screen conveyor.

2. A vehicle for feeding and screening material comprising an elongate vehicle frame having hitch structure for detachably connecting the frame to a towing vehicle, wheel means providing wheel support for the frame, an elongate inclined power-driven material-transport conveyor extending lengthwise along the vehicle frame having a feed end adjacent one end of the vehicle frame and a raised discharge end located toward the vehicle's opposite end, an inclined screen assembly having a feed end adjacent and in receiving relation to the discharge end of the material-transport conveyor and inclining downwardly form its feed end to a discharge end disposed adjacent the vehicle's opposite end, the screen assembly having at least two decks and including an upper deck retaining the coarse material supplied to the screen assembly by the material-transport conveyor and a lower deck retaining material of smaller size than the material retained by the upper deck, material-channelling structure mounted on the vehicle frame in receiving relation to the upper deck of the screen assembly and constructed to channel material deposited on the structure beyond said opposite end of the vehicle frame, and an adjustable conveyor adjustably mounted on the vehicle frame and adjustable from an inoperative position to an extended position extending laterally of the vehicle frame, the adjustable conveyor receiving material retained on the lower deck of the screen assembly.

3. A vehicle for feeding and screening material comprising:

an elongated vehicle frame and wheel support for the frame, an elongate inclined power-driven material-transport conveyor extending lengthwise along the vehicle frame having a feed end adjacent one end of the vehicle frame and a discharge end located toward the vehicle's opposite end, a material-receiving hopper disposed over the feed end of the material-transport conveyor, an inclined screen assembly having a feed end adjacent the discharge end of the material-transport conveyor and inclining downwardly toward a discharge end located adjacent the vehicle's opposite end, an adjustable conveyor supported on the vehicle frame an adjustable from an inoperative position to an extended position extending laterally of the vehicle from a feed end which is in material-receiving relation to the discharge end of the screen assembly, and an under-screen conveyor mounted on the vehicle frame in a position beneath the screen assembly with a feed end adjacent the discharge end of the screen assembly and extending from said feed end to a discharge end located toward the vehicle's said one end.

4. The vehicle of claim 3, which further includes another adjustable conveyor supported on the vehicle frame having a feed end disposed in receiving relation to the discharge end of the under-screen conveyor and adjustable from an inoperative to an extended position extending laterally of the vehicle frame.

5. The vehicle of claim 4, wherein the screen assembly includes at least two decks, with an upper deck retaining relatively course material and a lower deck retaining finer material, and which further includes material-channelling structure receiving material from the upper deck and channelling such beyond the vehicle's said opposite end, the under-screen conveyor being in a position receiving material passing through the lower deck of the screen assembly.

6. The vehicle of claim 5, which further includes first, second, and third support leg structures secured to the vehicle frame adjacent the vehicle frame's said opposite end, the vehicle frame's said one end, and at a region intermediate the ends of the vehicle frame, respectively, adapted to support the vehicle frame on the ground independently of the wheel support.

7. A vehicle for feeding and screening material comprising an elongate vehicle frame having hitch structure for detachably connecting the frame to a towing vehicle, wheel means providing wheel support for the frame, an elongate inclined power-driven material-transport conveyor extending lengthwise along the vehicle frame having a feed end adjacent one end of the vehicle and a raised discharge end located toward the vehicle's opposite end and intermediate the ends of the vehicle, an inclined screen assembly having a feed end adjacent and in receiving relation to the discharge end of the material-transport conveyor and inclining downwardly from its feed end and progressing toward the vehicle's opposite end to a discharge end for the screen assembly which is disposed adjacent the vehicle's opposite end, the screen assembly having at least two decks and including an upper deck retaining the course material supplied to the screen assembly by the material-transport conveyor and a lower deck retaining material of smaller size than the material retained by the upper deck, material retained on the upper deck and on leaving the upper deck being directed beyond said opposite end of the vehicle frame, and an adjustable conveyor adjustably mounted on the vehicle frame and adjustable between an inoperative position and an extended position extending laterally of the vehicle frame, the adjustable conveyor receiving material retained on the lower deck of the screen assembly.

8. The vehicle of claim 7, which further includes an under-screen conveyor mounted on the vehicle frame in a position beneath the screen assembly with a feed end adjacent the discharge end of the screen assembly and extending from said feed end to a discharge end located toward the vehicle's said one end.

* * * * *

US005234564C1

(12) EX PARTE REEXAMINATION CERTIFICATE (9166th)

United States Patent
Smith

(10) Number: US 5,234,564 C1
(45) Certificate Issued: Aug. 7, 2012

(54) MOBILE SCREEN ASSEMBLY FOR RUBBLE AND DEBRIS

(76) Inventor: Roger G. Smith, Lake Oswego, OR (US)

Reexamination Request:
No. 90/008,447, Jan. 26, 2007

Reexamination Certificate for:

| | |
|---|---|
| Patent No.: | **5,234,564** |
| Issued: | **Aug. 10, 1993** |
| Appl. No.: | **07/918,841** |
| Filed: | **Jul. 24, 1992** |

(51) Int. Cl.

| | |
|---|---|
| ***B07B 1/00*** | (2006.01) |
| ***B07B 13/16*** | (2006.01) |
| ***B07B 1/28*** | (2006.01) |
| ***B07B 13/00*** | (2006.01) |
| ***B07B 1/49*** | (2006.01) |

(52) U.S. Cl. ..... 209/241; 209/257; 209/317; 209/421

(58) Field of Classification Search ..... None
See application file for complete search history.

(56) References Cited

To view the complete listing of prior art documents cited during the proceeding for Reexamination Control Number 90/008,447, please refer to the USPTO's public Patent Application Information Retrieval (PAIR) system under the Display References tab.

*Primary Examiner*—Jeanne M Clark

(57) ABSTRACT

A vehicle for feeding and screening material including a wheel-supported vehicle frame and a material-transport conveyor extending from one end of the vehicle frame to a raised end located between the ends of the vehicle frame. A multiple deck screen assembly forms an extension of the material-transport conveyor, and inclines downwardly toward a discharge end located at the opposite end of the vehicle frame. Off-bearing conveyors are adjustable to transport screened material laterally of the vehicle frame.

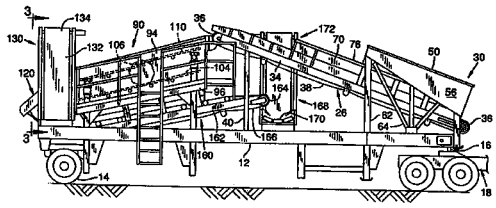

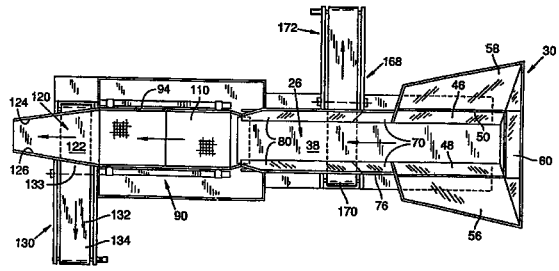

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 2 and 5-8 are cancelled.

Claims 3 and 4 were not reexamined.

* * * * *